US007356993B2

(12) United States Patent
Smith

(10) Patent No.: US 7,356,993 B2
(45) Date of Patent: Apr. 15, 2008

(54) METHOD OF CONVERTING ENERGY

(76) Inventor: Douglas Wilbert Paul Smith, 3753 Sefton St., Port Coquitlam, BC (CA) V3B 3R6

( * ) Notice: Subject to any disclaimer, the term of this patent is extended or adjusted under 35 U.S.C. 154(b) by 39 days.

(21) Appl. No.: 10/523,135

(22) PCT Filed: Jul. 18, 2003

(86) PCT No.: PCT/CA03/01077

§ 371 (c)(1),
(2), (4) Date: Jan. 21, 2005

(87) PCT Pub. No.: WO2004/009964

PCT Pub. Date: Jan. 29, 2004

(65) Prior Publication Data

US 2006/0010868 A1 Jan. 19, 2006

(30) Foreign Application Priority Data

Jul. 22, 2002 (CA) ..... 2393386

(51) Int. Cl.
*F01K 25/08* (2006.01)

(52) U.S. Cl. ..... 60/651; 60/653; 60/671

(58) Field of Classification Search ..... 60/645, 60/655, 676, 670, 646, 649, 651, 653, 657, 60/671; 290/52
See application file for complete search history.

(56) References Cited

U.S. PATENT DOCUMENTS 4,346,561 A 8/1982 Kalina
4,422,297 A 12/1983 Rojey
4,489,563 A 12/1984 Kalina
4,548,043 A * 10/1985 Kalina ..... 60/673
5,440,882 A * 8/1995 Kalina ..... 60/651
5,557,936 A * 9/1996 Drnevich ..... 60/651
5,664,419 A * 9/1997 Kaplan ..... 60/641.2
5,822,990 A * 10/1998 Kalina et al. ..... 60/655
5,953,918 A * 9/1999 Kalina et al. ..... 60/653
6,347,520 B1 * 2/2002 Ranasinghe et al. ..... 60/651

(Continued)

OTHER PUBLICATIONS

Advanced Power Cycles with Mixtures as the Working Fluid, Maria Jonsson, Doctoral Thesis, Department of Chemical Engineering and Technology, Energy Processes, Royal Institute of Technology, Stockholm, Sweden, 2003.

(Continued)

*Primary Examiner*—Hoang Nguyen
(74) *Attorney, Agent, or Firm*—Laurence C. Bonar

(57) ABSTRACT

The invention provides a method of converting heat energy to a more usable form using a multi-component working fluid mixture that contains ammonia and water. The working fluid is operated in a thermodynamic cycle that includes liquid compression (30), vaporization (33), expansion through a turbine (34) and condensing (36). The multi-component fluid varies in temperature during phase change allowing for the use of counter-flow heat exchangers for the heater (33), cooler (36), recuperator and pre-heater (32). Significant recuperation is possible due to the temperature change during phase change. A pre-heater (32) can be applied to ensure only single-phase vapour exists within the heater. The invention can be used in conjunction with a biomass combustor or with waste flue gas from an existing industrial process. The coolant exits at a temperature sufficient to allow use in external heating applications or to minimize the size of external heat rejection equipment.

8 Claims, 8 Drawing Sheets

U.S. PATENT DOCUMENTS

| | | | | |
|---|---|---|---|---|
| 6,629,413 | B1 * | 10/2003 | Wendt et al. | 60/670 |
| 6,751,959 | B1 * | 6/2004 | McClanahan et al. | 60/670 |
| 6,941,757 | B2 * | 9/2005 | Kalina | 60/651 |
| 6,968,690 | B2 | 11/2005 | Kalina | |
| 7,007,453 | B2 * | 3/2006 | Maisotsenko et al. | 60/39.511 |
| 2003/0000213 | A1 * | 1/2003 | Christensen et al. | 60/670 |

OTHER PUBLICATIONS

Power Cycles With Ammonia-Water Mixtures as Working Fluid, Eva Thorin Doctoral Thesis, Department of Chemical Engineering and Technology, Energy Processes, Royal Institute of Technology, Stockholm, Sweden, 2000.

* cited by examiner

METHOD OF CONVERTING ENERGY

TECHNICAL FIELD

Many industries produce wastes in the form of beat or biomass as a byproduct of their process. Environmental awareness has increased and effort is made to mitigate the consequences of these waste products. For instance, the cement industry produces particulate laden flue gases that must be cooled and cleaned before being released. In the forest industry it is undesirable to landfill biomass due to leaching but burning produces particulate in the flue gas that must be removed. Even though there are many installations that burn biomass without particulate removal systems, there is significant pressure for these practices to change. The useful recovery of heat from the flue gas of waste heat processes or biomass-fueled burners is usually determined to be uneconomical. Very large conversion plants may be economically justified only if they can locate sufficient biomass fuel within a reasonable transportation distance.

The use of waste heat for beneficial purposes is limited as it is economically justified in only specific applications. It has also been found uneconomical to convert heat to electricity using traditional technology as operating costs become excessive for small systems. Co-generation systems that produce both electricity and useful heat greatly improve the economics.

BACKGROUND ART

Conversion of waste heat to electricity involves the steam-water Rankine cycle in most practical systems. The traditional steam power plant is based on any of a variety of fuels including nuclear, coal, oil, wood, etc. and, along with hydroelectric installations, has been the backbone of the electrical power-grid of North America Steam systems have a number of advantages. Water (steam) is readily available and environmentally benign. Water has a large enthalpy change over typical pressure ranges. The Rankine cycle operates at temperatures and pressures that are fairly convenient. There are many competitive suppliers of equipment. Finally, the knowledge of owners, engineers, operators and maintenance personnel is well developed.

Steam systems have a number of disadvantages. Water has a tendency to erode, corrode and dissolve materials used in piping and equipment and contaminants accumulate in the re-circulating fluid. Water has an affinity to absorbing air that greatly degrades the system performance. Thus the boiler water must be treated chemically and continuously deaerated. For higher efficiency, most steam systems are operated in a vacuum at the heat rejection temperature. Air accumulates in the condenser and must be continually removed to maintain the vacuum and the low condensing temperature. Removing air is both an added equipment complexity and a parasitic energy load on the system. Also since the specific volume of low-pressure steam is very large, the condensing equipment can grow to enormous sizes. Operating requirements are legally mandated in most jurisdictions and require trained and skilled operators in constant attendance. Consequently steam systems become uneconomical in smaller power output sizes and when the heat source temperature is low.

Hydrocarbon fluids, most typically butanes and pentanes, have been used in geothermal power generating plants and similar applications where the heat source temperature is limited. These fluids operate similar to steam-water systems with the exception that they are closed systems and are under pressure at the heat rejection temperature. Such fluids are relatively expensive, flammable and environmentally sensitive. Their lower enthalpy characteristics require greater pressure ratios that need multi-stage turbines and greater flow rates that negate some of the equipment size reduction benefits of the positive pressure at rejection temperature. There are fewer suppliers and fewer knowledgeable operating and maintenance personnel available.

A related but different power cycle has been developed and patented by Alexander I. Kalina and is described in numerous patents; including U.S. Pat. No. 4,346,561, U.S. Pat. No. 4,489,563, U.S. Pat. No. 4,548,043, U.S. Pat. No. 4,586,340, U.S. Pat. No. 4,604,867, U.S. Pat. No. 4,732,005, U.S. Pat. No. 4,763,480, U.S. Pat. No. 4,899,545, U.S. Pat. No. 5,095,708, U.S. Pat. No. 5,103,899. The Kalina power cycle uses a mixture of water and ammonia for the purpose of increasing the energy conversion efficiency that can be obtained using the standard steam Rankine cycle. The cycle operates through a process of heating the binary fluid mixture, partially separating the components and applying the two fluid streams differently to enhance the overall efficiency of the power cycle. All the developments and teachings of Mr. Kalina build on this basic approach of component separation within the power cycle and differ from the present invention.

DISCLOSURE OF INVENTION

The thermodynamic cycle of the present invention, applied to an ammonia-water working fluid mixture, is described on a Temperature-Entropy diagram in FIG. 6 and displays high-pressure line 65 and low-pressure line 69 overlayed on saturation dome 60 of said working fluid. The simplest arrangement of equipment necessary to operate the cycle of FIG. 6 is described in FIG. 2. Feedpump 30 increases said working fluid pressure 69 and temperature 1 to pressure 65 and temperature 2. Said working fluid leaves feedpump 30 as a liquid and is directed into the first thermal side of heater 33. Heater 33 has said first thermal side separated from a second thermal side such that heat only is transferred between said first thermal side and said second thermal side. A second fluid enters said second thermal side of heater 33 at temperature 16; such temperature 16 being greater than desired said working fluid temperature 7. Said second fluid cools to heater 33 outlet temperature 17; such temperature 17 being greater than temperature 2 of said working fluid. While passing through heater 33, said working fluid heats as a liquid from temperature 2 to bubble point 3, vaporizes to the dew point 6 and heats as a vapour to temperature 7. It is an aspect of this invention that temperature 17 of said second fluid may be less than dew point temperature 6 of said working fluid by using a counter-flow heat exchanger as heater 33.

Said working fluid vapour 7 is reduced in pressure through turbine 34 that extracts energy 24 from said working fluid. Turbine 34 may be any device capable of extracting energy from a fluid through a pressure and enthalpy reduction and is most typically a turbine of any one or more well-known styles. Said working fluid leaves turbine 34 at lower pressure 69, temperature 8 and increased entropy and is directed into the first thermal side of cooler 36. Cooler 36 has said first thermal side separated from a second thermal side such that heat only is transferred between said first thermal side and said second thermal side. A third fluid enters said second thermal side of cooler 36 at temperature 18; such temperature 18 being less than desired temperature 1 of said working fluid. Said third fluid heats in cooler 36 to outlet temperature 21; such temperature 21 being less than temperature 8 of said working fluid. While passing through cooler 36, said working fluid cools as a vapour from temperature 8 to dew point 9, condenses to bubble point 13 and cools as a liquid to temperature 1. It is an aspect of this invention that temperature 21 of said third fluid may be greater than temperature 1 of said working fluid by using a counter-flow heat exchanger as cooler 3.

FIG. 3 describes a practical enhancement of the equipment definition of FIG. 2. Cooler 36 is replaced by cooler 37 and cooler 38 that, together, perform the same function as cooler 36. Cooler 37 has a first thermal side separated from a second thermal side such that heat only is transferred between said first thermal side and said second thermal side. Cooler 38 has a first thermal side separated from a second thermal side such that heat only is transferred between said first thermal side and said second thermal side. The change in temperature 8-1 of said working fluid may, in some circumstances, be more conveniently accomplished by using a different fluid in said second thermal side of cooler 37 than the fluid in said second thermal side of cooler 38. In FIG. 3 it is shown that said working fluid enters said first thermal side of cooler 37 at temperature 8 and leaves cooler 37 at temperature 12. Temperature 12 may be greater than or less than dew point temperature 9. A fourth fluid enters said second thermal side of cooler 37 at temperature 20; such temperature 20 being less than temperature 12 of said working fluid. Said fourth fluid heats in cooler 37 to outlet temperature 21; such temperature 21 being less than temperature 8 of said working fluid. It is an aspect of this invention that temperature 21 of said fourth fluid may be greater than temperature 12 of said working fluid by using a counter-flow heat exchanger as cooler 37. It is also recognized in this invention that said fourth working fluid may be selected to be ambient air, or other available fluid, and may be used in a heat exchanger with temperature 21 being less than said working fluid temperature 12. A fifth fluid enters said second thermal side of cooler 38 at temperature 18; such temperature 18 being lower than temperature 1 of said working fluid. Said fifth fluid heats in cooler 38 to outlet temperature 19; such temperature 19 being less than temperature 12 of said working fluid. While passing through said first thermal side of cooler 38, said working fluid cools from temperature 12 to temperature 1. It is an aspect of this invention that temperature 19 of said fifth fluid may be greater than temperature 1 of said working fluid by using a counter-flow heat exchanger as cooler 38.

FIG. 4 describes an important enhancement of the equipment arrangement described in FIG. 2 and FIG. 3. Feedpump 30 increases said working fluid from pressure 69 and temperature 1 to pressure 65 and temperature 2. Said working fluid leaves feedpump 30 as a liquid and is directed into the first thermal side of recuperator 31. Recuperator 31 has said first thermal side separated from a second thermal side such that heat only is transferred between said first thermal side and said second thermal side. Said first thermal side of recuperator 31 receives said working fluid at pressure 65 temperature 2. While passing through said first thermal side of recuperator 31, said working fluid heats as a liquid to bubble point 3 and then partially vaporizes to temperature 5. Said working fluid at pressure 65 and temperature 5 is then directed to said first thermal side of heater 33. Said second thermal side of recuperator 31 receives said working fluid at pressure 69 and temperature 8 after said working fluid leaves turbine 34. While passing through said second thermal side of recuperator 31, said working fluid cools as a vapour to dew point 9 and then partially condenses to temperature 11. Said working fluid at pressure 69 and temperature 11 is then directed to said first thermal side of cooler 36.

Recuperator 31 operates in three distinct regions in the heat transfer process. In said first thermal side of recuperator 31, said working fluid is at pressure 65 and changes from temperature 2 at the inlet, to bubble point temperature 3 within, to partially vaporized temperature 4 within, to partially vaporized temperature 5 at the outlet. In said second thermal side of recuperator 31, said working fluid is at pressure 69 and changes from temperature 8 at the inlet, to dew point temperature 9 within, to partially condensed temperature 10 within, to partially condensed temperature 11 at the outlet. Said working fluid at pressure 65 must be connected to recuperator 31 in counter-flow to said working fluid at pressure 69. Operation of recuperator 31 requires temperature 8 greater than temperature 5, temperature 9 greater than temperature 4, temperature 10 greater than temperature 3 and temperature 11 greater than temperature 2. The "pinch temperature" of closest temperature approach of said first thermal side and said second thermal side will occur in the region of recuperator 31 bounded by temperature 9 to temperature 4 on one extreme and by temperature 10 to temperature 3 on the other extreme.

Heater 33 operates in FIG. 4 in the same manner as in FIG. 2 except that said second fluid temperature 17 must be greater than said working fluid temperature 5. Cooler 36 operates in FIG. 4 in the same manner as in FIG. 2 except that said third fluid temperature 21 must be less than said working fluid temperature 11. Cooler 37 and cooler 38 as seen in FIG. 3 may replace cooler 36 in FIG. 4 in the same manner as they replaced cooler 36 in FIG. 2 except that said fourth fluid temperature 21 must be less than said working fluid temperature 11.

FIG. 5 describes a further enhancement of the equipment arrangement described in FIG. 4. Said working fluid at pressure 65 leaves recuperator 31 at temperature 5; such temperature 5 being less than dew point temperature 6. Said working fluid at temperature 5 is directed into a first thermal side of pre-heater 32. Pre-heater 32 has said first thermal side separated from a second thermal side such that heat only is transferred between said first thermal side and said second thermal side. While passing through said first thermal side of pre-heater 32, said working fluid vaporizes to dew point 6 and possibly to a higher temperature. Said working fluid at pressure 65 and temperature 6 is then directed to said first thermal side of heater 33. Said first thermal side of heater 33 is segregated into two sections in series; a first section that heats said working fluid from temperature 6 to temperature 14 and a second section that heats said working fluid from temperature 15 to temperature 7. Said working fluid leaving said first section of said first thermal side of heater 33 is directed into said second thermal side of pre-heater 32. While passing through said second thermal side of pre-heater 32, said working fluid cools as a vapour to temperature 15. Said working fluid at pressure 65 and temperature 15 is then directed to said second section of said first thermal side of heater 33.

Figure 7:
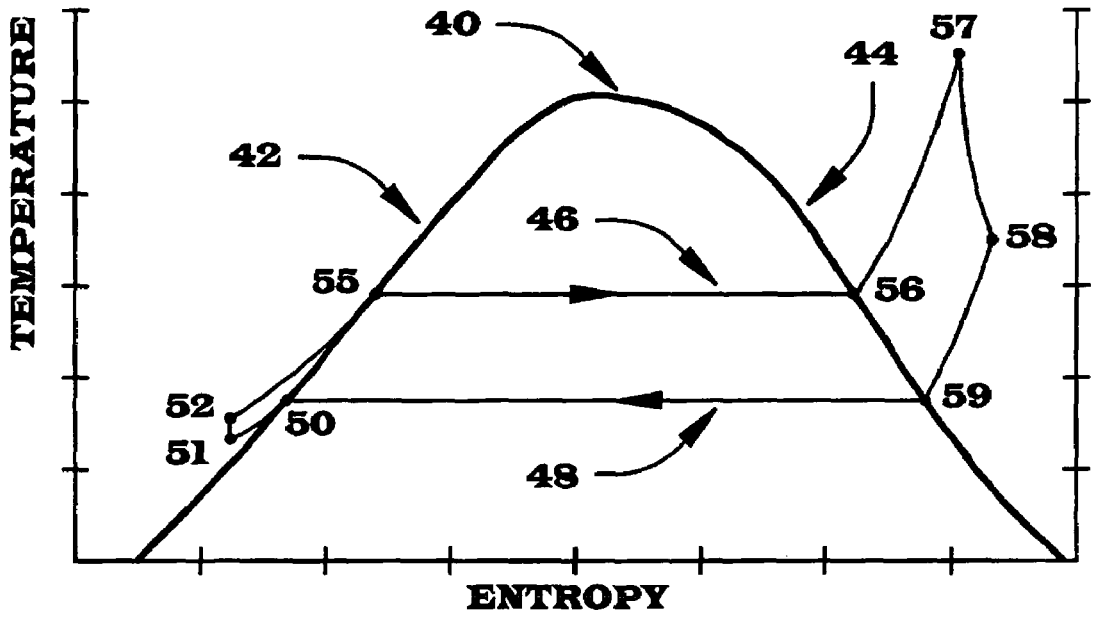
FIG. 7 is a Temperature-Entropy diagram showing the Rankine cycle for a steam-water system

The Rankine cycle is described on a Temperature-Entropy diagram in FIG. 7 and displays high-pressure line 46 and low-pressure line 48 overlayed on saturation "dome" 40 of a usable fluid. Saturation dome 40 of said usable fluid is formed by saturated liquid line 42 on the left and saturated vapour line 44 on the right. High-pressure line 46 shows a temperature rise heating said usable fluid as a liquid to saturation 52-55, a constant temperature vaporizing said usable fluid 55-56 and a temperature rise superheating said usable fluid as a vapour 56-57. Energy is extracted from said usable fluid 57-58 causing the pressure to reduce to low-pressure line 48. Low-pressure line 48 shows a temperature drop cooling said usable fluid as a vapour to saturation 58-59, a constant temperature condensing said usable fluid 59-50 and a temperature drop subcooling said usable fluid as a liquid 50-51. Said usable fluid is pressurized 51-52 as a liquid, increasing the pressure to high-pressure line 46, completing the cycle. Said usable fluid of this Rankine cycle description may be steam, hydrocarbon or any suitable single component fluid although the shape of the saturation dome 40 may differ for different fluids.

Figure 8:
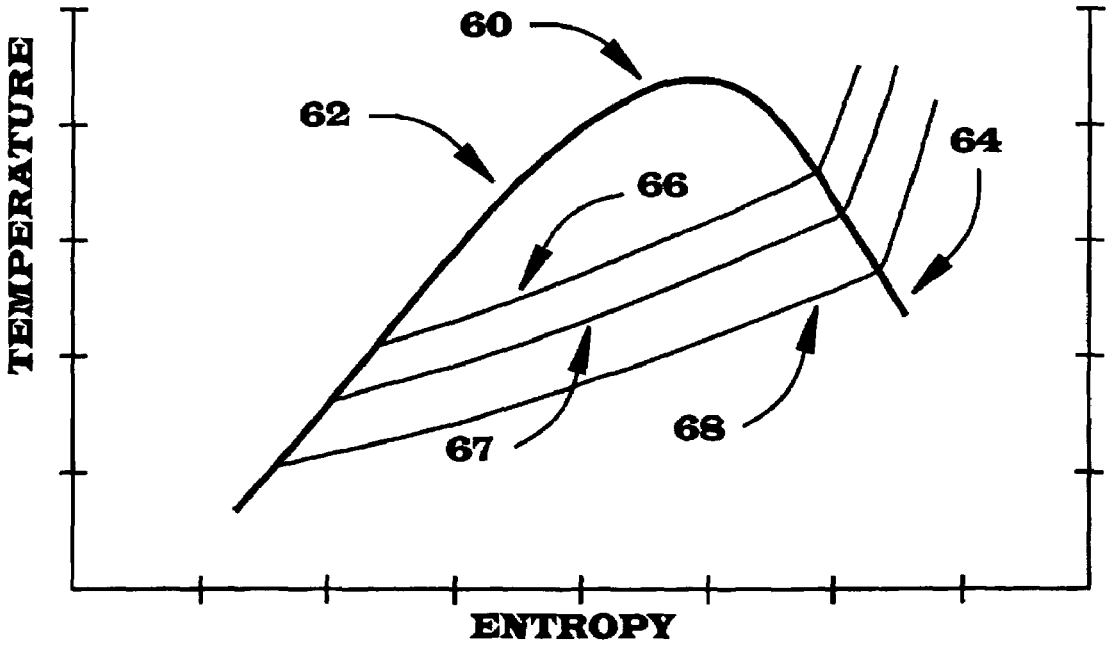
FIG. 8 is a Temperature-Entropy diagram showing the two-phase characteristics of an ammonia-water fluid mixture.

The present invention recognizes and applies a fundamental difference in the two-phase characteristics of multi-component fluids from those of single component fluids. FIG. 8 depicts the two-phase characteristics of a binary mixture of ammonia and water. Saturation "dome" 60 is defined by bubble point line 62 on the left and dew point line 64 on the right. Line 66 represents a constant high-pressure through the two-phase region and into the superheat region. Similarly line 67 is at a medium pressure and line 68 is at a low pressure. The temperature rise across the two-phase region 62-64 reflects the fact that components of the fluid vaporize at different rates and thus the ratio of these components in the liquid phase differs from the ratio of these components in the vapour phase. However the ratio of components at or below the bubble point 62 and the ratio of components at or above the dew point 64 are the same. The variation of component ratio in the two-phase region is used for component separation as taught by Kalina and as used in product purification systems. The present invention does not use the variation of component ratio characteristic but only the characteristic of temperature difference between the bubble point 62 and the dew point 64. By way of example, an 80% ammonia in water mixture has a temperature difference between the bubble point 62 and the dew point 64 at a constant pressure that can exceed 150° F.

BEST MODE FOR CARRYING OUT THE INVENTION

Figure 6:
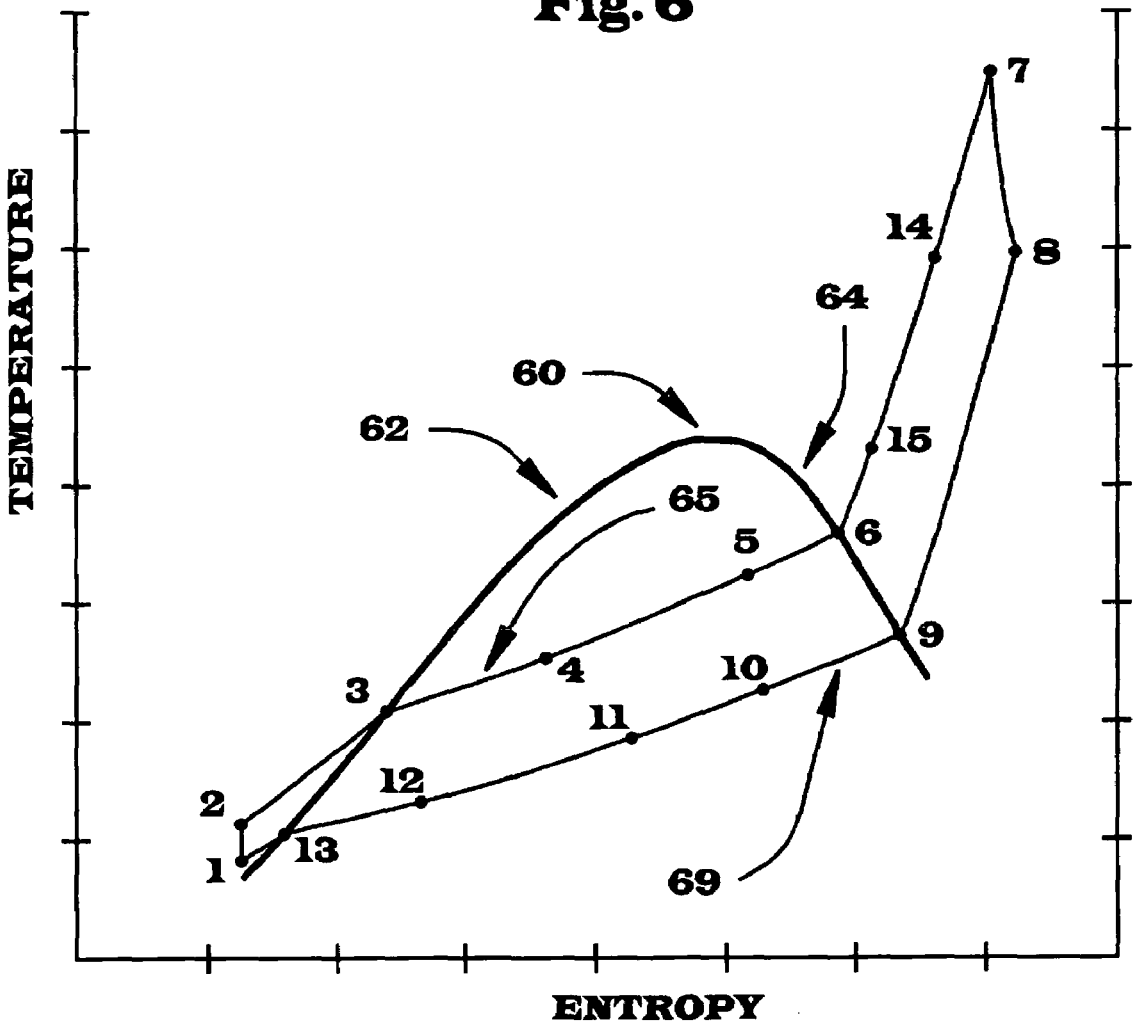
FIG. 6 is a Temperature-Entropy diagram showing the thermodynamic cycle of the present invention.
Figure 9:
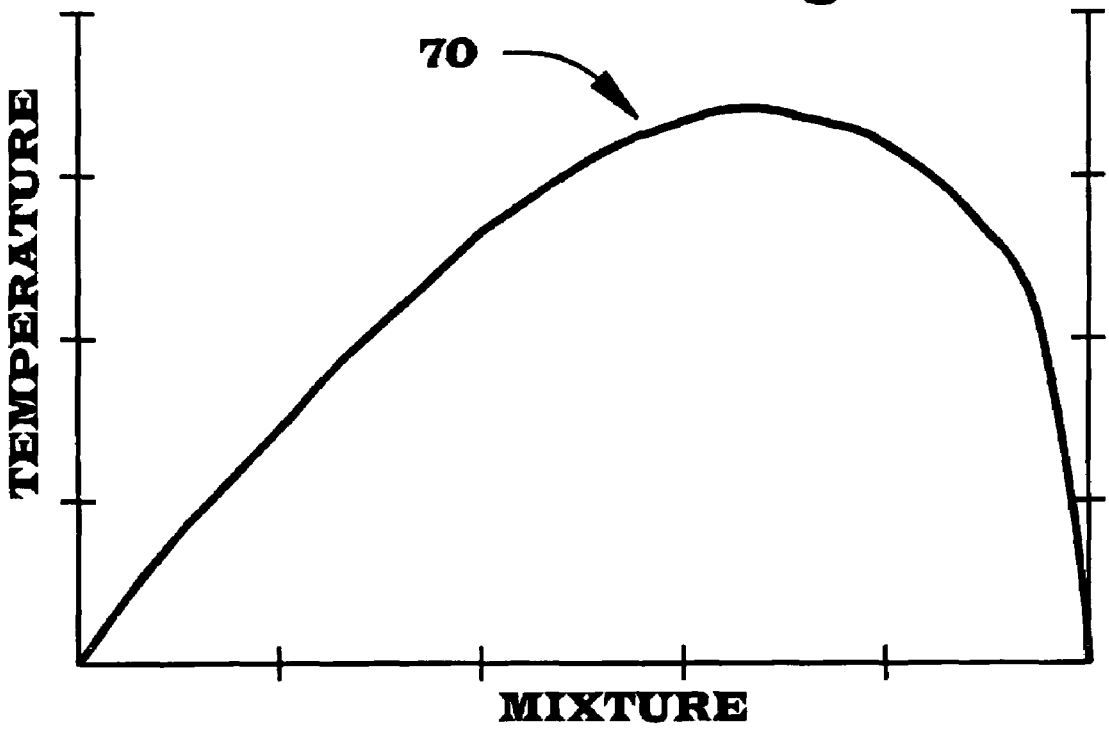
FIG. 9 is a Temperature-Mixture diagram showing how the temperature change of an ammonia-water mixture across a two-phase region changes with the percent mixture ratio of the component fluids.

Selection of said working fluid is important for the practical application of the present invention. Although many multi-component fluids can be used as said working fluid, the preferred selection is a binary mixture of ammonia and water. Ammonia is a common industrial fluid, relatively inexpensive, readily mixes with water, not flammable, not a greenhouse gas and relatively environmentally benign. In high concentrations ammonia is a health hazard but it has the advantage of releasing a highly objectionable odour at very low concentrations, which serves to encourage early evacuation of a contaminated area FIG. 9 describes by way of example the temperature change across a two-phase region from bubble point 62 to dew point 64 at a constant pressure, as shown in FIG. 6, as it relates to the percent of ammonia in the mixture. The maximum change in temperature from bubble point 62 to dew point 64 approaches 170° F. at about 75% ammonia and exceeds 100° F. over a range from 30% ammonia to 95% ammonia. This large useable range allows the percent ammonia of said working fluid to be selected to best match conditions of available source temperature 16, available heat sink temperature 18, or desired heat reject temperature 21 in a particular application.

A useful comparison of thermodynamic cycles equates the high-pressure and high-temperature as well as the low temperature of the cycles. The high pressure is selected largely by equipment design consideration. The high temperature and the low temperature define the maximum potential efficiency of the system. The ammonia-water thermodynamic cycle is defined in FIG. 6 by high-pressure line 65, low-pressure line 69, pressurizing line 1-2 and expanding line 7-8. The steam-water Rankine cycle is defined in FIG. 7 by high-pressure line 46, low-pressure line 48, pressurizing line 51-52 and expanding line 57-58. By way of comparison of said ammonia-water thermodynamic cycle of the present invention to said steam-water Rankine cycle, the high-pressure and the low temperature selections will be matched in this description.

Figure 2:
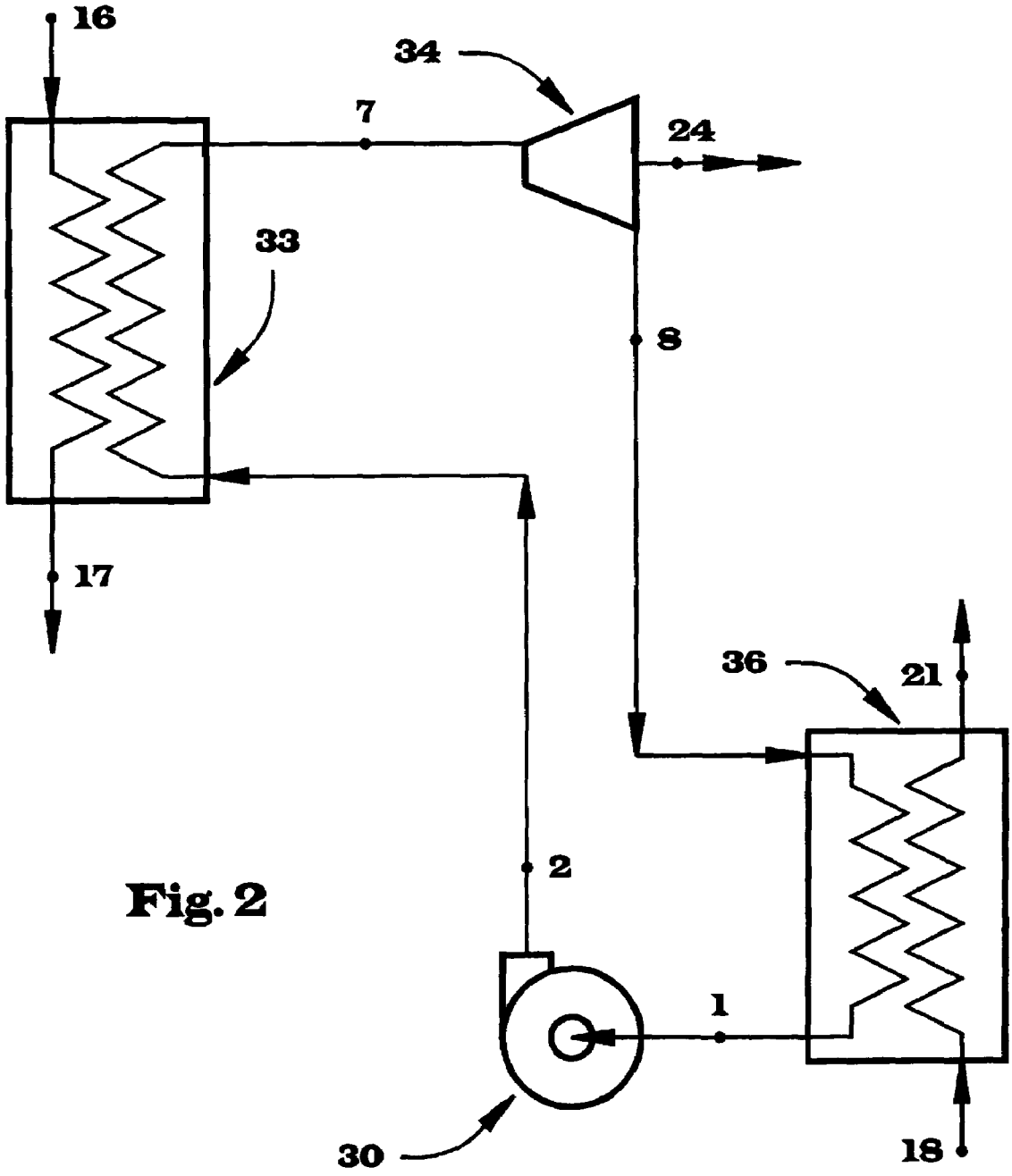
FIG. 2 is a description of the simplest form of equipment arrangement of the present invention.
Figure 3:
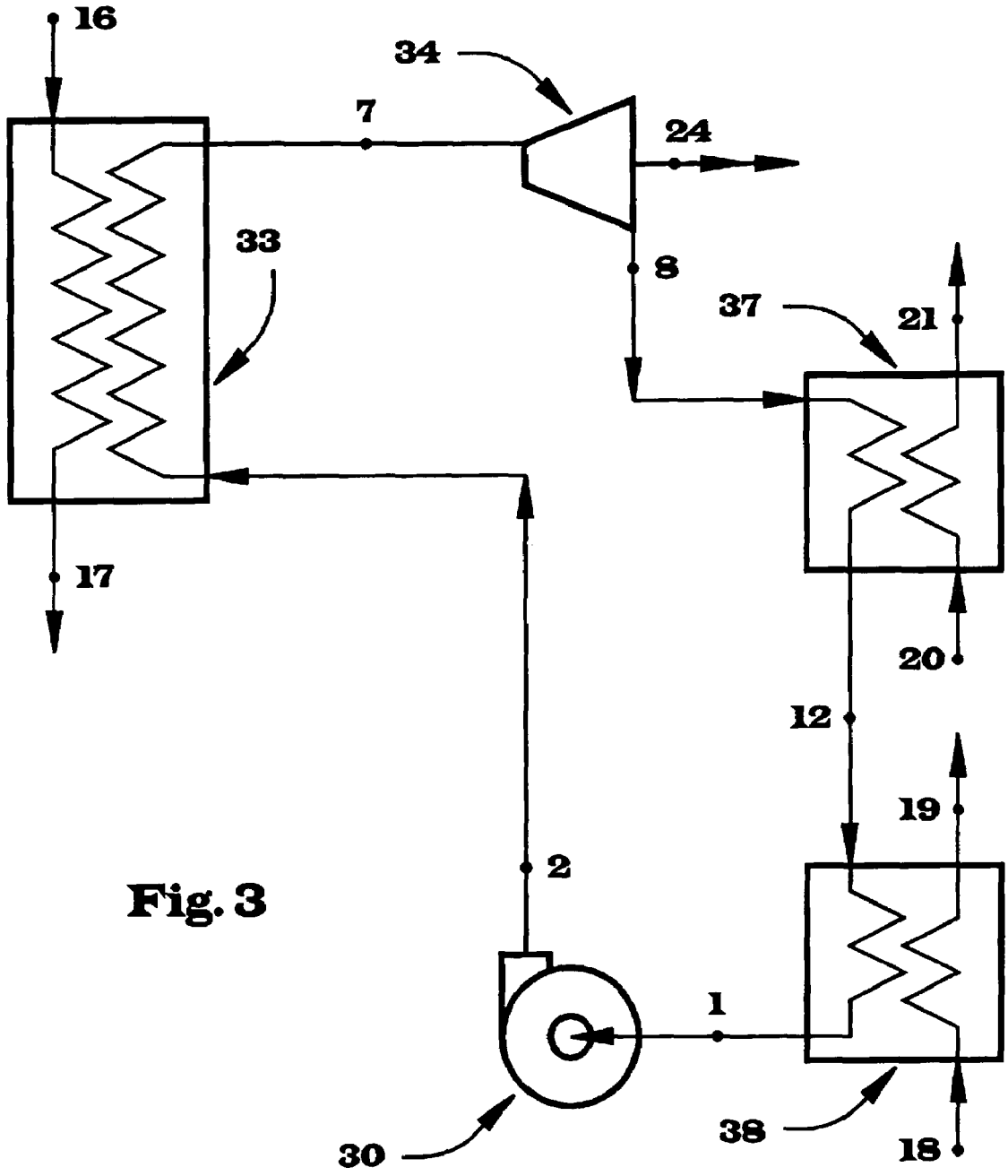
FIG. 3 is a description of a modification of FIG. 2 that may also be applied to FIG. 4 and FIG. 5.
Figure 4:
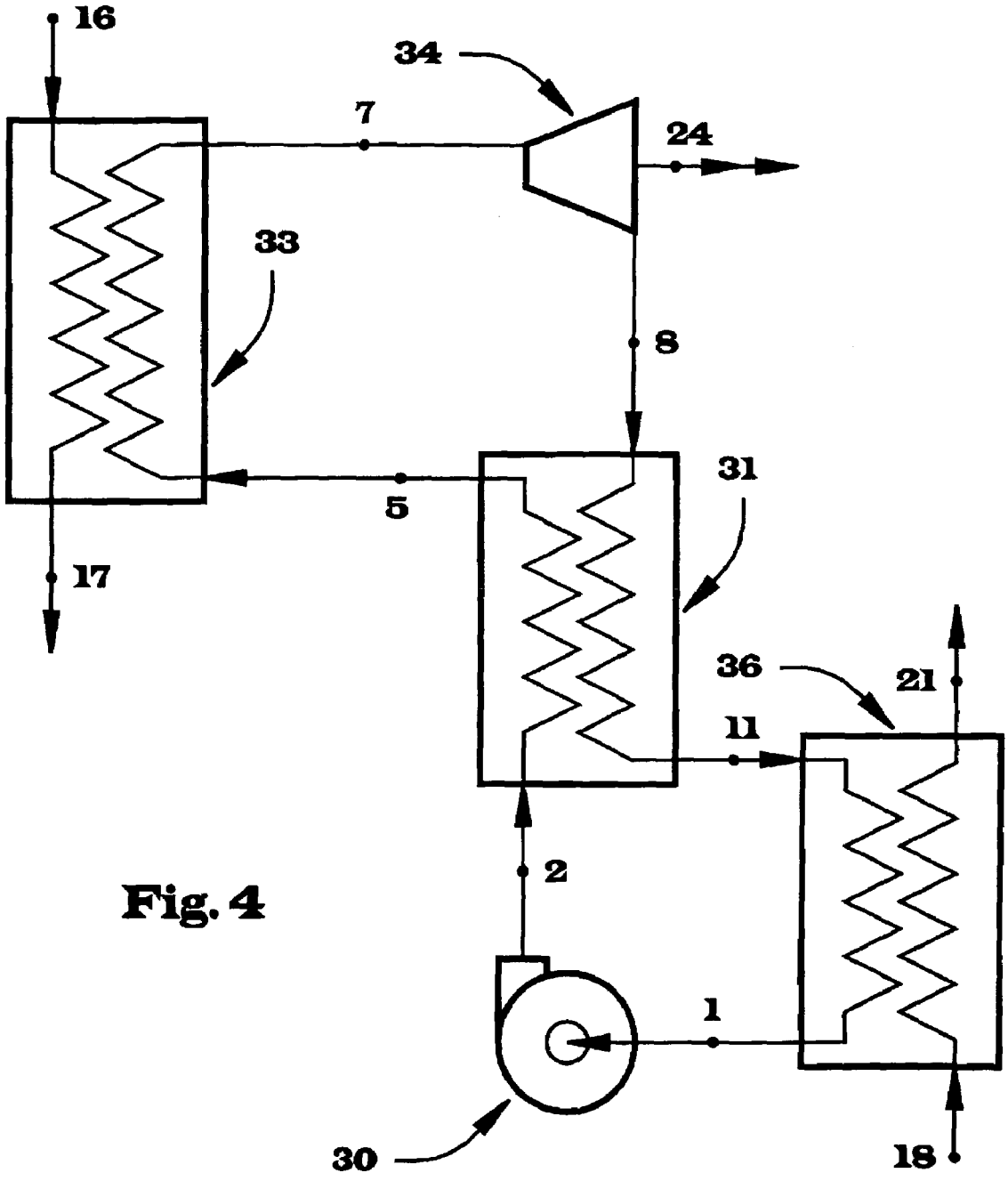
FIG. 4 is an extension of the equipment arrangement shown in FIG. 2 with an added recuperator exchanger.

FIG. 2 describes heater 33 that supplies the source heat at temperature 16 for said ammonia-water thermodynamic cycle. Applying said counter-flow heat exchanger for heater 33 allows greater heat to be extracted from said second fluid by lowering outlet temperature 17 below the temperature available using said steam-water Rankine cycle. By way of example, equivalent temperature 17 leaving equivalent heater 33 in said steam-water Rankine cycle described in FIG. 7 operating at high-pressure 46 of 400 psia would be greater than the vaporizing temperature 55-56 of 444.7° F. Temperature 17 leaving heater 33 in said ammonia-water thermodynamic cycle described in FIG. 6 operating at high-pressure 65 of 400 psia would be greater than the bubble point temperature 3 of 164.3° F. It is readily seen that more energy can be extracted by said ammonia-water thermodynamic cycle than by said steam-water Rankine cycle using equipment arrangement described in FIG. 2. When applied to the equipment arrangement of FIG. 5 temperature 17 leaving heater 33 in said ammonia-water thermodynamic cycle operating at high-pressure 65 of 400 psia would be greater than the dew point temperature 6 of 323.2° F. It is readily seen that more energy can be extracted by said ammonia-water thermodynamic cycle than by said steam-water Rankine cycle using equipment arrangement described in FIG. 5. It is readily apparent that more energy can be extracted by said ammonia-water thermodynamic cycle than by said steam-water Rankine cycle using equipment arrangement described in FIG. 3 and in FIG. 4.

FIG. 2 describes cooler 36 that said third fluid enters at temperature 18 and receives the rejected heat of said ammonia-water thermodynamic cycle. Applying said counter-flow heat exchanger for cooler 36 allows less flow of said third fluid to receive heat rejected from said working fluid by increasing outlet temperature 21 above the temperature that would be possible using said steam-water Rankine cycle. By way of example, equivalent temperature 21 leaving equivalent cooler 36 in said steam-water Rankine cycle operating at about 0.79 psia would be less than the condensing temperature of 93.8° F. Temperature 21 leaving cooler 36 in said ammonia-water thermodynamic cycle operating at a bubble point 3 of 93.8° F. and low-pressure 69 of 150 psia must be less than said working fluid temperature 8 that exceeds dew point temperature 6 of 260.6° F. It is readily seen that less flow of said third fluid is required as said third fluid is raised to higher outlet temperature 21 of cooler 36 by said ammonia-water thermodynamic cycle than by said steam-water Rankine cycle using equipment arrangement described in FIG. 2. When applied to the equipment arrangement of FIG. 4 and of FIG. 5, temperature 21 leaving cooler 36 in said ammonia-water thermodynamic cycle operating at low-pressure 69 of 150 psia would be less than outlet temperature 11 of recuperator 31 of about 150° F. It is readily seen that less flow of said third fluid is required as said third fluid is raised to higher outlet temperature 21 of cooler 36 by said ammonia-water thermodynamic cycle than by said steam-water Rankine cycle using equipment arrangement described in FIG. 4 and FIG. 5. It is readily apparent that less flow of said third fluid is required as said third fluid is raised to higher outlet temperature 21 of cooler 36 by said ammonia-water thermodynamic cycle than by said steam-water Rankine cycle using equipment arrangement described in FIG. 3. It is also readily apparent that higher outlet temperature 21 of said ammonia-water thermodynamic cycle may be used effectively for unrelated, beneficial heating applications or cooled to cooler 36 inlet temperature 18 using smaller equipment than would otherwise be necessary.

Turbine 34 is most typically a turbine of any one or more well-known styles and is the single most costly component of the practical application of said ammonia-water thermodynamic cycle. Turbine 34 extracts energy from said working fluid using pressure drop 7-8 from high-pressure 65 to low-pressure 69. Turbine 34 must handle the amount of said working fluid flow by its overall size and the amount of pressure drop 7-8 by its number of stages. An increase in said size or an increase in said number of stages relates directly to an increase in cost of turbine 34. Selection of preferred ammonia-water mixture for said working fluid maintains an overall size comparable to using steam-water and much reduced size than using pentane or butane. Introduction of recuperator 31 allows a decrease in said number of stages required for turbine 34. The flow of said working fluid may be increased while high-pressure 65 may be decreased to reduce to one the number of stages required by turbine 34. It is found that the loss of energy extracted by reducing pressure drop 7-8 is largely compensated by increased flow of said working fluid due to the action of recuperator 31.

Recuperator 31 is limited in operation by bubble point 3 and dew point 6 of high-pressure 65 in comparison to bubble point 13 and dew point 9 of low-pressure 69. As high-pressure 65 is reduced, the temperature differences 8-5, 9-4, 10-3 and 11-2 are increased. This allows more heat to transfer from said working fluid leaving turbine 34 to said working fluid leaving feedpump 30 and allows a greater flow of said working fluid. Said greater flow of said working fluid largely compensates in turbine 34 for the reduced pressure drop 7-8 and the cost of turbine 34 is reduced substantially. Operation of recuperator 31 significantly increases the efficiency of said ammonia-water thermodynamic cycle.

Figure 10:
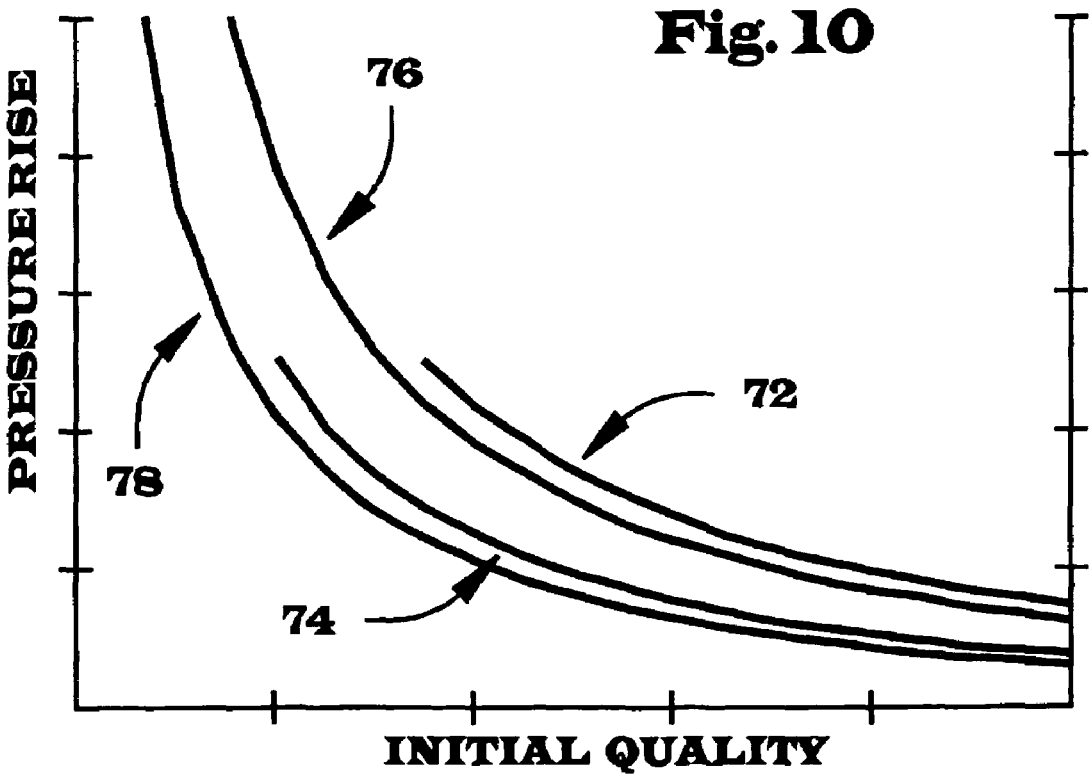
FIG. 10 is a Pressure-Quality diagram showing how the pressure rise of a confined fluid resulting from a temperature increase changes with the amount of vapour in the initial fluid mixture.

There is a significant safety concern associated with vaporizing fluids due to the volumetric change that takes place during phase change. Typical systems for vaporizing liquids may have a limited upper temperature but usually have an "effectively unlimited" amount of energy that can be transferred. FIG. 10 describes the pressure rise associated with heat input to a fluid of an initial pressure of 375 psia. Line 76 and line 78 describe water-steam raised to 1800° F. and 1000° F. respectively. Line 72 and line 74 describe ammonia-water raised to 1800° F. and 1000° F. respectively. The initial fluid quality is defined as the percent of vapour in the fluid before heat is added and ranges from saturated liquid on the left to saturated vapour on the right. It is readily seen in FIG. 10 that said pressure rise of fluid that initially comprises 60% or more in vapour phase is limited while said pressure rise of fluid that initially comprises 100% liquid is extremely high.

Figure 5:
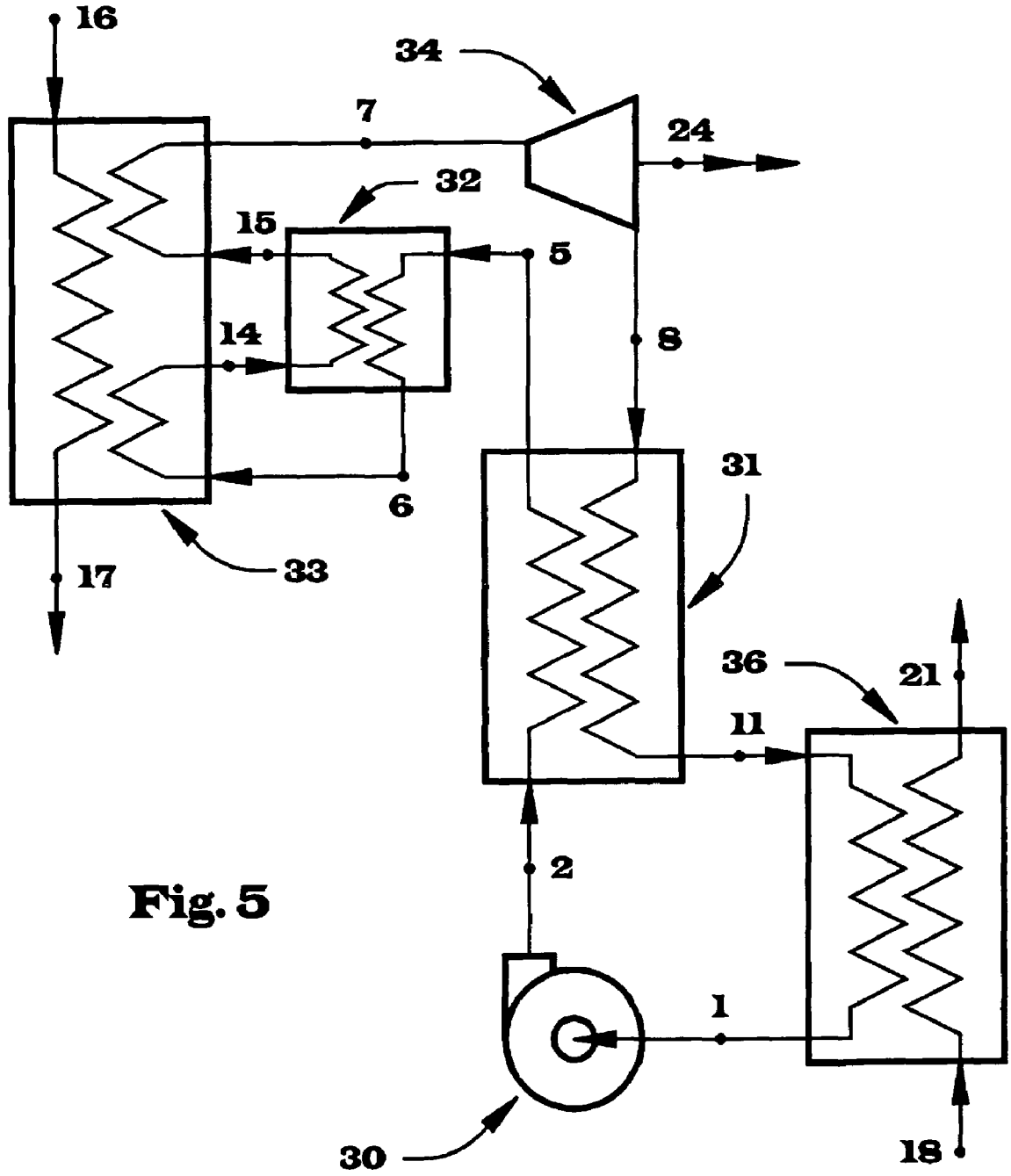
FIG. 5 is an extension of the equipment arrangement shown in FIG. 4 with an added pre-heat exchanger.

FIG. 5 describes pre-heater 32 that said working fluid enters at temperature 5 and is heated to dew point temperature 6 or greater. Heat transferred to heat said working fluid from temperature 5 to temperature 6 is supplied by said working fluid at temperature 14 that cools to temperature 15. Pre-heater 32 ensures that only vapour phase of said working fluid exists in said first thermal side of heater 33. If said first thermal side of heater 33 was blocked such that said working fluid was confined, the pressure rise due to expansion of said working fluid would be limited as said working fluid would have an initial quality of 100%. All vaporization of said working fluid in equipment arrangement of FIG. 5 is effected in recuperator 31 and pre-heater 32. If said first thermal side of recuperator 31 was blocked such that said working fluid was confined, the pressure rise due to expansion of said working fluid would be limited as said working fluid flow through said second thermal side of recuperator 31 would cease due to said blockage, a limited amount of heat would be available to be transferred and the temperature of said working fluid in said second thermal side of recuperator 31 would drop during heat transfer. It is readily apparent that a similar situation exists within pre-heater 32 with respect to confined heating of said working fluid. Thus the equipment arrangement described in FIG. 5 holds a greater inherent safety than the equipment arrangement described in FIG. 2. It is also readily seen that the equipment arrangement described in FIG. 4 holds a greater inherent safety than the equipment arrangement described in FIG. 2 as said working fluid at temperature 5 is typically between 70% and 90% quality.

Pre-heater 32 described in FIG. 5 increases the efficiency of said ammonia-water thermodynamic cycle slightly. However, outlet temperature 17 of heater 33 is higher when pre-heater 32 is operated and thus less energy is transferred from said second fluid to said ammonia-water thermodynamic cycle. The net result is that less energy 24 can be extracted by turbine 34. Pre-cooler 32 is useful when the application requires that the system safety with respect to heating of a confined working fluid be maximized. Pre-cooler 32 is also useful when temperature 17 of said second fluid must be maintained higher than dew point temperature 6 for reasons independent of said ammonia-water thermodynamic cycle.

Figure 1:
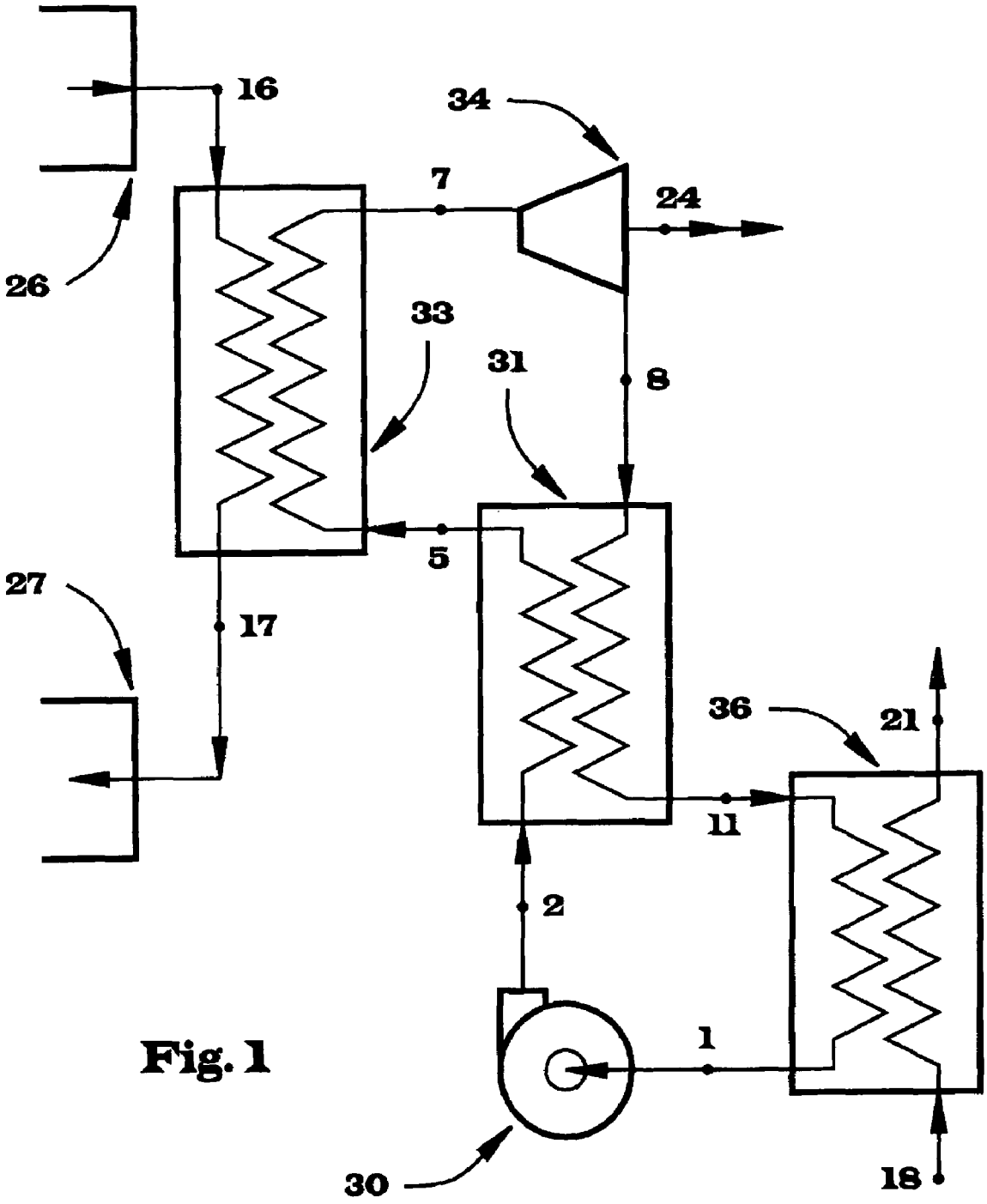
FIG. 1 is a description of a preferred form of equipment arrangement of the present invention.

FIG. 1 describes a preferred application of the present invention that converts biomass waste into electricity in a small cost effective system. Biomass combustion system 26 burns waste and produces said second fluid as a flue gas of temperature 16. The flue gas is directed as said second fluid into said second thermal side of heater 33, leaves heater 33 at temperature 17 and is directed to flue gas cleaning system 27. Combustion system 26 and flue gas cleaning system 27 are commercially available systems using known technologies. Temperature 17 is sufficiently low to increase the technology options applicable to cleaning the flue gas. By way of example, reducing flue gas temperature 17 to less than 451° F. will reduce it below the ignition temperature of cellulose and make cleaning technologies, such as baghouses, safer to use. Further reducing temperature 17 makes such cleaning equipment safer by reducing the likelihood of "sparklers" reaching sensitive components.

The system described in FIG. 1 can be illustrated by operating conditions of a particular design using said working fluid comprising 80% ammonia and 20% water. Said design operates between a peak high-pressure of 375 psig and a minimum low-pressure of 145 psig. Burning 900 bone-dry pounds per hour of hog fuel containing 50% moisture can produce 10,600 pounds per hour of flue gas at 1750° F. that is introduced to heater 33 as said second fluid. Using a counter-flow heat exchanger for heater 33, the flue gas is cooled to 399° F. Recuperator 31 evaporates 84% of said working fluid liquid at high-pressure 65 and condenses 58% of said working fluid vapour at low-pressure 69. Turbine 34 outputs 295 kilowatts, however the cycle uses an equivalent of 7.3 kilowatts during operation. The net cycle efficiency is 20.5%. Cooler 36 is a counter-flow heat exchanger and receives a coolant as said third fluid of temperature 18 at 80° F. and heats said coolant to temperature 21 at 152° F. Temperature 21 is sufficient to be useful for specific space heating applications. Alternately, the coolant can be cooled in a relatively small heat exchanger by ambient air and, if required, cooled further to temperature 18 by a minimal volume flow of water.

The system described in FIG. 1 can also be illustrated by different operating conditions of an alternate. design using said working fluid comprising 50% ammonia and 50% water. Said alternate design operates between a peak high-pressure of 375 psig and a minimum low-pressure of 145 psig. Burning 900 bone-dry pounds per hour of hog fuel containing 50% moisture can produce 10,600 pounds per hour of flue gas at 1750° F. that is introduced to heater 33 as said second fluid. Using a counter-flow heat exchanger for heater 33, the flue gas is cooled to 411° F. Recuperator 31 evaporates 72% of said working fluid liquid at high-pressure 65 and condenses 58% of said working fluid vapour at low-pressure 69. Turbine 34 outputs 242 kilowatts, however the cycle uses an equivalent of 6.8 kilowatts during operation. The net cycle efficiency is 17.0%. Cooler 36 is a counter-flow heat exchanger and receives a coolant as said third fluid of temperature 18 at 140° F. and heats said coolant to temperature 21 at 194° F. Coolant temperature 18 and temperature 21 match the typical operating range of a district heating system. Alternately, the coolant can be cooled in a relatively small heat exchanger by ambient air.

| | PARTICULAR DESIGN | | ALTERNATE DESIGN | |
|---|---|---|---|---|
| Biomass: | 900 BDlb/hr @ 50% moisture | | 900 BDlb/hr @ 50% moisture | |
| Flue Gas: | 10,600 lb/hr | | 10,600 lb/hr | |
| State 16/17: | 1750° F. 399° F. | | 1750° F. 411° F. | |
| Working Fluid: | 80% ammonia/20% water | | 50% ammonia/50% water | |
| State 1: | 95° F., 145 psig | 0% vapour | 150° F., 145 psig | 0% vapour |
| State 2: | 101° F., 375 psig | 0% vapour | 150.2° F., 375 psig | 0% vapour |
| State 5: | 293° F., 369 psig | 84% vapour | 343° F., 369 psig | 72% vapour |
| State 7: | 775° F., 365 psig | 100% vapour | 775° F., 367 psig | 100% vapour |
| State 8: | 625° F., 152 psig | 100% vapour | 612° F., 152 psig | 100% vapour |
| State 11: | 159° F., 146 psig | 42% vapour | 228° F., 145 psig | 42% vapour |
| Coolant Glycol: | 104 usgpm | | 143 usgpm | |
| State 18/21: | 80° F. 152° F. | | 140° F. 194° F. | |
| Power produced: | 295 kW | | 242 kW | |
| Parasitic power: | 7.3 kW | | 6.8 kW | |
| Net cycle efficiency: | 20.5% | | 17.0% | |

It is readily apparent that a practical system includes pipe connections between equipment operating as flow passages, isolation and control valves, seals, appropriate sensors, safety devices and control systems.

INDUSTRIAL APPLICABILITY

It is readily seen that this invention has applicability to energy recovery from waste industrial heat that is in the form of hot flue gas. Such heat is usually considered low-grade and is not recoverable on a commercially viable basis. This invention will allow conversion of the waste heat into high-grade electricity with an efficiency of conversion similar to, or better than, simplified steam-water Rankine systems. This invention has the further advantage of simple equipment and a direct heat rejection to the atmosphere that does not require evaporative systems. Thus this invention promises to be less expensive to construct and operate.

It is further seen that waste biomass can be used to generate the heat input for this invention. In such a scenario this invention offers a simplified system for generation of electricity with the added benefit of high-temperature heat rejection from a liquid coolant. This liquid coolant is readily available for co-generation which enhances the potential overall efficiency of energy recovery.

For those schooled in the art it is readily apparent that many applications exist to implement this invention. Further it is readily apparent that this invention can be scaled to larger or smaller sizes that are suitable to the particular application.

The invention claimed is:

1. A method of extracting heat from a hot gas to generate electricity using a multi-component working fluid comprising ammonia and water in a single continuous stream, comprising the steps of:

a. pressuring said working fluid in liquid form in a feedpump;

b. heating said working fluid liquid in a recuperator to its boiling point and partially vaporizing it;

c. further heating the entirety of said working fluid liquid-vapor mixture in a heater to fully vaporize it and further heating the entirety of said working fluid to a superheated vapor state, said heater comprising a heat exchanger using said hot gas that supplies heat to said working fluid liquid-vapor mixture and arranged in counter-flow to said working fluid mixture;

d. reducing the pressure and enthalpy of said superheated working fluid mixture by expansion through a turbine, and using said turbine to generate electricity;

e. cooling and partially condensing the low-pressure working fluid mixture emerging from said turbine in said recuperator, which is arranged in counter-flow to said high-pressure working fluid liquid from said feedpump, and partially vaporizing said high-pressure working fluid liquid;

f. further cooling and completely condensing said low-pressure working fluid in a cooler, said cooler being a heat exchanger using a second fluid that absorbs heat from the working fluid and arranged in counter-flow to the working fluid;

g. returning the low-pressure liquid working fluid leaving said cooler to said feedpump to form a closed loop system.

2. The method as recited in claim 1, wherein:

said low-pressure working fluid leaving said recuperator is cooled in a first cooler to a temperature higher than its fully condensed temperature, such first cooler being a heat exchanger using a second fluid that absorbs heat from the working fluid and arranged in counter-flow to the working fluid; and said low-pressure working fluid leaving the first cooler is cooled and fully condensed in a second cooler, such second cooler being a heat exchanger using a third fluid that absorbs heat from the working fluid and arranged in counter-flow to the working fluid.

3. The method as recited in claim 1, wherein:

said partially vaporized high-pressure working fluid from said recuperator is fully vaporized in a pre-heater prior to being introduced to said heater;

said superheated high-pressure working fluid is directed from the heater to said pre-heater to supply vaporization energy and returned to the heater for continued superheating;

said pre-heater arranged with partially vaporized working fluid in counter-flow to the superheated working fluid.

4. The method as recited in claim 1 wherein said hot gas that supplies heat to said working fluid in said heater is a flue gas produced by combusting biomass.

5. The method as recited in claim 1 wherein said hot gas that supplies heat to said working fluid in said heater is a flue gas produced as a waste product of an existing industrial process.

6. An apparatus for converting heat to electricity, comprising:

a multi-component working fluid containing ammonia and water;

a feedpump for pressurizing said multi-component working fluid;

a recuperator for heating and partially vaporizing said high-pressure working fluid leaving the feedpump using heat from cooling and partially condensing low-pressure working fluid leaving a turbine, such recuperator arranged in counter-flow; connection means for conveying the entirety of said partially vaporized high-pressure working fluid to a heater;

a heater for fully vaporizing and superheating the entirety of said high-pressure working fluid which has been partially vaporized before entering said heater;

a turbine for expanding the superheated working fluid to a low-pressure and extracting useful energy to generate electricity; and a cooler for cooling and condensing said low-pressure working fluid which has been partially condensed in said recuperator before entering the cooler.

7. The apparatus as claimed in claim 6 wherein said cooler comprises:

a first cooler heat exchanger to extract heat from said low-pressure working fluid which as been partially condensed in said recuperator to heat a second fluid; and a second cooler heat exchanger for further extracting heat from said low-pressure working fluid which as been partially condensed in said recuperator and said first cooler unit to heat a third fluid.

8. The apparatus as claimed in claim 6 further comprising:

a pre-heater to fully vaporize the entirety of said high-pressure working fluid leaving the recuperator in partially vaporized state by using superheated high-pressure working fluid directed from the heater and arranged in counter-flow, and returning said superheated high-pressure working fluid to the heater for continued superheating;

connection means for conveying the entirety of said high pressure working fluid from said recuperator to said pre-heater; and connection means for conveying the entirety of said superheated high-pressure working fluid to said pre-heater.

* * * * *